US005878459A

United States Patent [19]

McParland

[11] Patent Number: 5,878,459

[45] Date of Patent: Mar. 9, 1999

[54] TOILET BRUSH

[76] Inventor: Kelly McParland, 782 Spruce Rd., Warminster, Pa. 18974

[21] Appl. No.: 853,946

[22] Filed: May 9, 1997

[51] Int. Cl.[6] ..... A47L 13/12

[52] U.S. Cl. ..... 15/114; 15/144.1; 15/144.4; 15/160; 15/172; 15/184; 403/220; 403/291

[58] Field of Search ..... 15/106, 114, 144.1, 15/144.4, 160, 164, 172, 184; 403/220, 223, 228, 229, 291

[56] References Cited

U.S. PATENT DOCUMENTS

| | | | |
|---|---|---|---|
| D. 337,659 | 7/1993 | Lacy | D4/116 |
| D. 345,271 | 3/1994 | Vetter | D6/551 |
| D. 356,893 | 4/1995 | Conmy | D4/116 |
| 439,914 | 11/1890 | Welsh et al. | 15/172 |
| 603,694 | 5/1898 | Kavanaugh | 15/144.1 X |
| 750,357 | 1/1904 | Gibbons | 15/160 |
| 1,466,454 | 8/1923 | Mock | 15/184 X |
| 2,668,312 | 2/1954 | Solomon | 15/144.1 X |
| 3,407,424 | 10/1968 | Lanzarone et al. | 15/144.4 X |
| 4,407,213 | 10/1983 | Evans | 114/222 |
| 4,730,361 | 3/1988 | Koffler | 15/160 |
| 4,802,782 | 2/1989 | Scalf | 401/138 |
| 4,850,074 | 7/1989 | Klevan | 15/144.1 X |
| 4,967,441 | 11/1990 | White | 15/114 |
| 5,333,345 | 8/1994 | O'Donnell | 15/159.1 |
| 5,377,377 | 1/1995 | Bredall et al. | 15/172 X |
| 5,384,930 | 1/1995 | Uno | 15/159.1 |
| 5,440,775 | 8/1995 | Banks | 15/106 |

*Primary Examiner*—Mark Spisich

*Attorney, Agent, or Firm*—Panitch Schwarze Jacobs & Nadel, P.C.

[57] ABSTRACT

A toilet brush having a handle portion and a scrubbing portion is provided. A flexible connection is provided between the handle portion and the scrubbing portion. A deflection limiter is located in proximity to the connection which limits deflection of the scrubbing portion in a first direction relative to the handle portion.

11 Claims, 2 Drawing Sheets

TOILET BRUSH

BACKGROUND OF THE INVENTION

The present invention relates to a toilet bowl cleaning device, and more particularly, to a toilet bowl cleaning brush which allows for easier cleaning under the rim of a toilet bowl.

One of the most difficult places to clean in a toilet bowl is the area under the rim. While ordinary conventional toilet brushes can reach these areas, they generally do not have sufficient scrubbing power to remove deposits and do not generally provide for uniform surface contact for thorough cleaning.

Although it is highly desirable to scrub under the rim of a toilet bowl in order to impede the growth of lime deposits and microorganisms, it has been difficult to do so due to the configuration of the generally known toilet brushes. Additionally, to the extent that a brush is forced into the area under the rim, the possibility exists of scratching or damaging the porcelain if the base material which holds the brush bristles contacts the porcelain surface due to the additional pressure placed on the brush to scrub this area.

One solution which has been proposed to this problem is to provide a toilet brush with a first brush having bristles which extend perpendicular to a longitudinal axis of the handle and a second brush affixed on an arm which extends outwardly from the handle and at an upward angle of approximately 45° such that the second brush can be used to scrub under the rim. However, having two brushes can make the scrubber difficult to store since the side arm extends sideways from the brush and as the brush drains, liquid from the second brush must also be captured. Additionally, the non-used brush can get in the way while the other brush is being used.

Another proposed brush utilizes a wire frame portion which extends forwardly and upwardly. Steel wool or other harsh scrub pad material is secured to the forward portion of the wire frame which is used to scrub under the rim of the toilet bowl. However, utilizing steel wool and a wire frame could result in scratching or otherwise damaging the porcelain if the user applies too much pressure or contacts the surface at the wrong angle causing the wire to contact the porcelain bowl surface.

It would be desirable to provide a cleaning device for a toilet bowl which is properly designed to be both ergonomic and to help prevent the possibility of scratching the porcelain surface, especially in hard to reach areas, by providing a brush which is ergonomically configured for under the rim scrubbing activity while at the same time avoiding the possibility of scratching the porcelain bowl surface.

BRIEF SUMMARY OF THE INVENTION

Briefly stated, the present invention provides a toilet brush having a handle portion and a scrubbing portion. A flexible connection is provided between the handle portion and the scrubbing portion. A deflection limiter is located in proximity to the connection which limits deflection of the scrubbing portion in a first direction relative to the handle portion.

In another aspect, the present provides a toilet brush having a handle portion and a scrubbing portion. A flexible connection is provided between the handle portion and the scrubbing portion. The flexible connection is configured for limited flexure of the handle relative to the scrubbing portion in a first direction, and a greater degree of flexure in a second direction opposite to the first direction.

In another aspect, the present invention provides a combination of a toilet brush and a carrying container. The toilet brush comprises a handle portion, a scrubbing portion and a flexible connection between the handle portion and the scrubbing portion. A deflection limiter is located in proximity to the flexible connection which prevents the scrubbing portion from flexing in a first direction relative to the handle portion. A container having an open end for receiving the scrubbing portion of the toilet brush is provided.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE INVENTION

Figure 2:
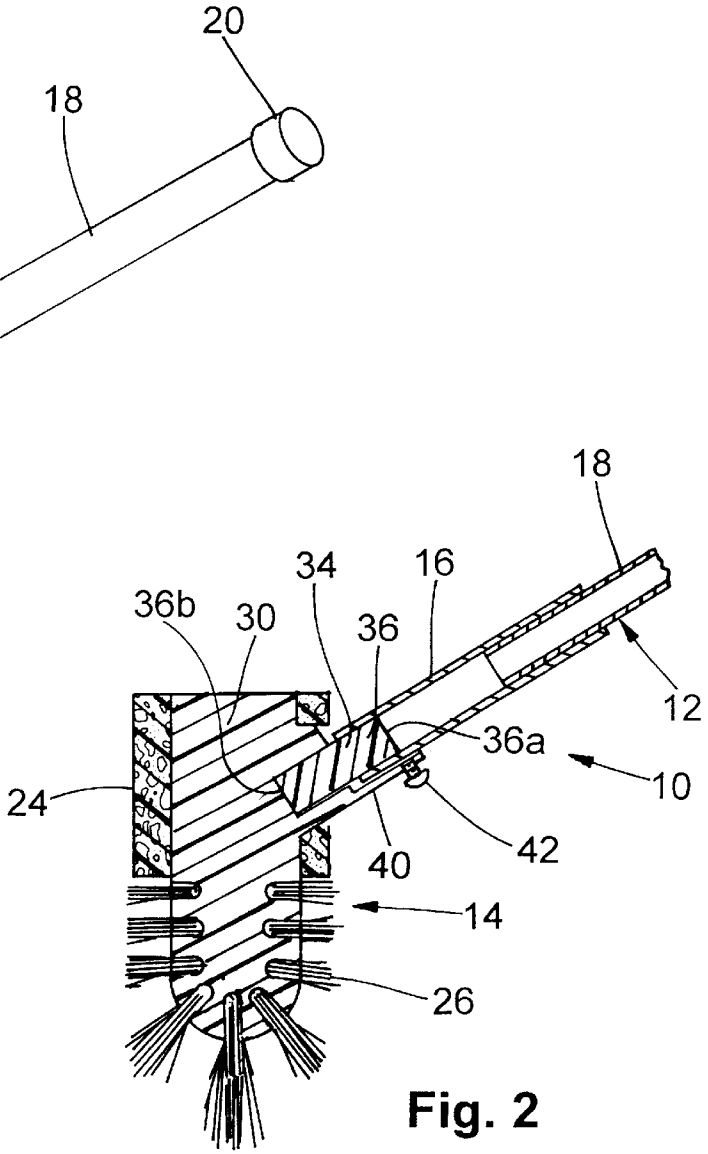
FIG. 2 is a cross-sectional view of the toilet brush in accordance with the present invention taken along lines 2—2 in FIG. 1.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the toilet brush, and designated parts thereof. The terminology includes the words specifically mentioned above, derivatives thereof and words of similar import.

Figure 1:
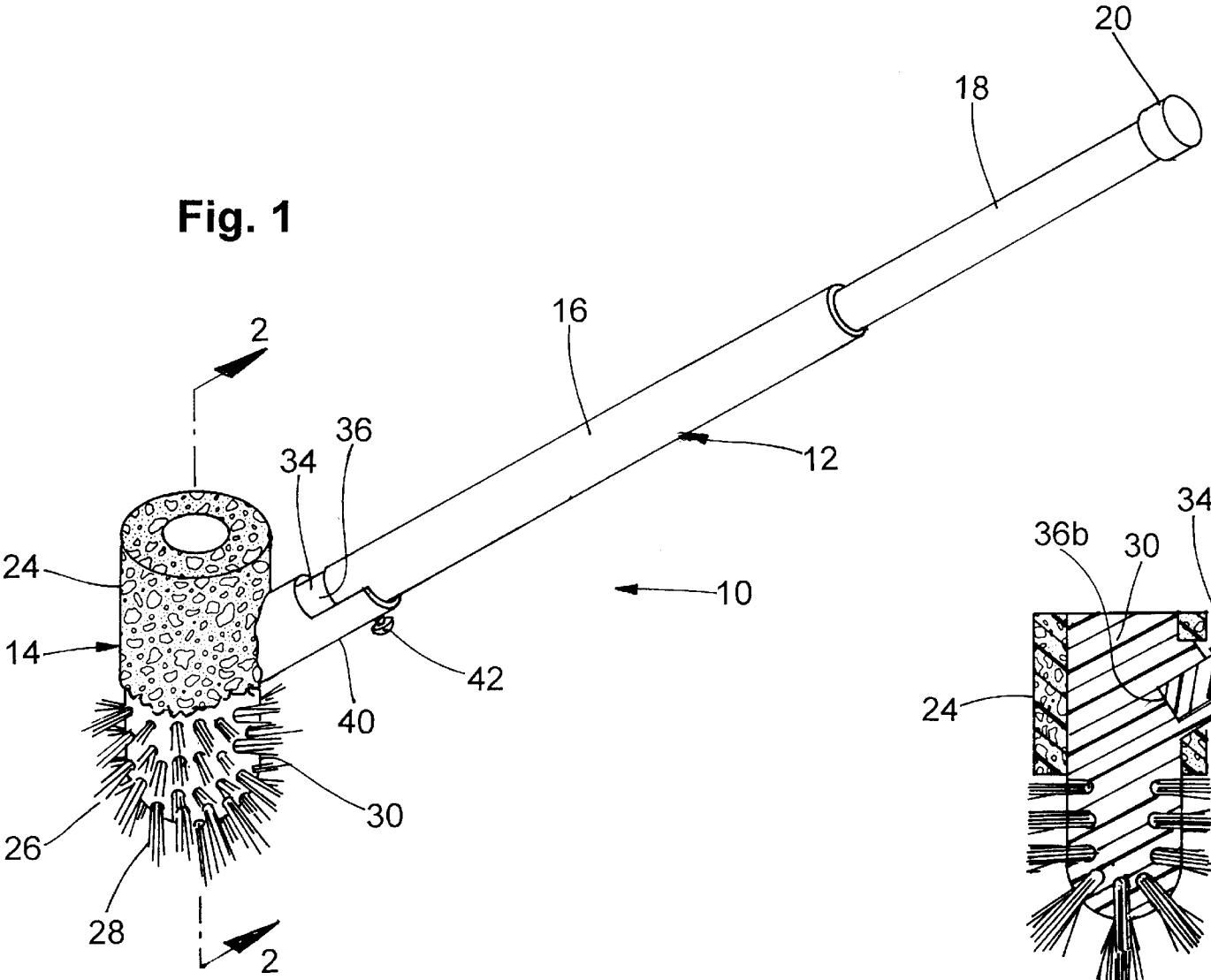
FIG. 1 is a perspective view of a first embodiment of a toilet brush in accordance with the present invention.

Referring to the drawings, wherein like numerals indicate like elements throughout, there is shown in FIG. 1 a first embodiment of a toilet brush 10 in accordance with the present invention. The toilet brush 10 includes a handle portion, generally designed 12, and a scrubbing portion, generally designated 14. The handle portion 12 preferably includes a first tube 16 which is connected to the scrubbing portion 14 and a second tube 18 which is telescopically disposed within the first tube 16. An end cap 20 is provided on the second tube 12. The first and second tubes can be extended, as shown in FIG. 1, in order to provide a longer handle for ease of use by the user or can be shortened by pressing the second tube 18 into the first tube 16 for compact storage.

Preferably, the first and second tubes 16 and 18 are made of a polymeric material. However, the first and second tubes 16, 18 can be made of a metallic material, if desired. It will be recognized by those skilled in the art from the present disclosure that a single piece handle portion 12 can be used, if desired, such as a single fixed tube 16 or a fixed handle having any desired shape, and that the present invention is not limited to the type of handle portion 12 which is used.

Still with reference to FIG. 1, the scrubbing portion 14 preferably includes a scrubbing pad portion 24 which extends at an acute angle relative to the handle portion 12. Preferably, a brush 26 extends in an opposite direction to the scrubbing pad portion 24, and away from the handle portion 12 at an obtuse angle.

In the preferred embodiment, the scrubbing pad portion 24 is made of a sponge material or a sponge backed non-woven polymeric scrubbing material. However, the type of scrubbing pad used is not considered limiting to the present invention and any type of scrubbing pad can be used, if desired. Preferably a sponge backed scrubbing material is provided in order to ensure more uniform contact between and evenly distributed pressure between the scrubbing pad portion 24 and the toilet bowl. The scrubbing pad portion 24 may be replaceable, if desired.

Preferably, the brush portion 26 includes bristles 28 which can be used for scrubbing the toilet bowl in the more accessible areas. In the preferred embodiment, the bristles 28 from which the brush 26 is formed have varying lengths, with the bristles 28 at the lower portion of the brush 26 having a longer length than the bristles 28 along the sides. Preferably, the bristles 28 are made of a polymeric material which is hydrolysis resistant and have sufficient stiffness for scrubbing the bowl surface. Preferably, the bristles 28 are mounted in a support block 30. Preferably, the support block 30 is made of a polymeric material, such that if the bristles deflect, only the polymeric material which will not scratch the porcelain surface of the toilet bowl contacts the bowl. It will be recognized by those skilled in the art from the present disclosure that the scrubbing portion 14 can be configured in many alternate ways, such as all bristles or all scrubbing pad or any combination thereof, if desired.

Still with reference to FIGS. 1 and 2, a flexible connection 34 is provided between the handle portion 12 and the scrubbing portion 14. The scrubbing pad portion 24 is located adjacent to the flexible connection 34. In the first preferred embodiment, as shown in FIGS. 1 and 2, the flexible connection 34 comprises an elastomeric material located between the handle portion 12 and the scrubbing portion 14. As shown in detail in FIG. 2, preferably the flexible connection 34 is an elastomeric plug 36 having a first end 36*a* which is inserted into the first tube 16 of the handle portion 12 and a second end 36*b* which is secured to the support block 30 of the scrubbing portion 14.

In the preferred embodiment, the elastomeric plug 36 is made of rubber, neoprene, or polypropylene. However, it will be recognized by those skilled in the art from the present disclosure that other suitable elastomeric materials can be used, if desired.

Still with reference to FIGS. 1 and 2, a deflection limiter 40 is located in proximity to the flexible connection 34 to limit deflection of the scrubbing portion 14 in a first direction relative to the handle portion 12. The deflection limiter 40 preferably extends outwardly from the support block 30 of the scrubbing portion 14 and overlaps the distal end of the handle portion 12 in proximity to the flexible connection 34. Preferably, the deflection limiter 40 is located in close proximity to the distal end of the handle portion 12 in the area between the handle portion 12 and the brush 26 such that as pressure is applied to the brush 26 during scrubbing, the scrubbing portion 14 has only limited deflection relative to the handle portion 12 in order to allow pressure to be applied to the brush 26 during scrubbing.

As shown in FIGS. 1 and 2, the deflection limiter further includes an adjustment screw 42 to adjust the limited amount of flexure which is available before the handle portion 12 contacts the adjustment screw 42 or the inside of the deflection limiter 40. It will be recognized by those skilled in the art from the present disclosure that the adjustment screw 42 can be omitted, if desired.

When pressure is applied on the scrubbing pad 24, such as during cleaning under the rim, the flexible connection 34 allows the scrubbing pad 24 to flex into a position such that uniform contact between the scrubbing portion 14 and the surface of the bowl is maintained in order to prevent possible scratching due to concentrated pressure applied at a single point as opposed to uniform pressure distributed along the entire tangent surface of the scrubbing pad 24 to the toilet bowl surface. The flexure provided by the flexible connection 34 also provides a more ergonomic brush for the user since the flexible connection 34 ensures contact with the various angled surfaces around the rim of the toilet bowl as they vary around the bowl periphery.

Figure 4:
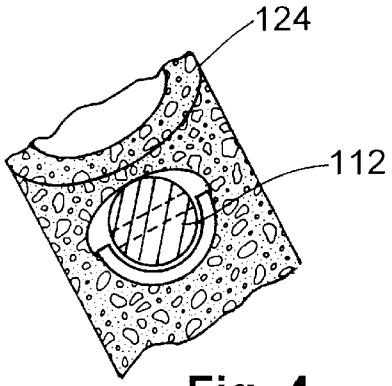
FIG. 4 is a sectional view taken along lines 4—4 in FIG. 3.
Figure 3:
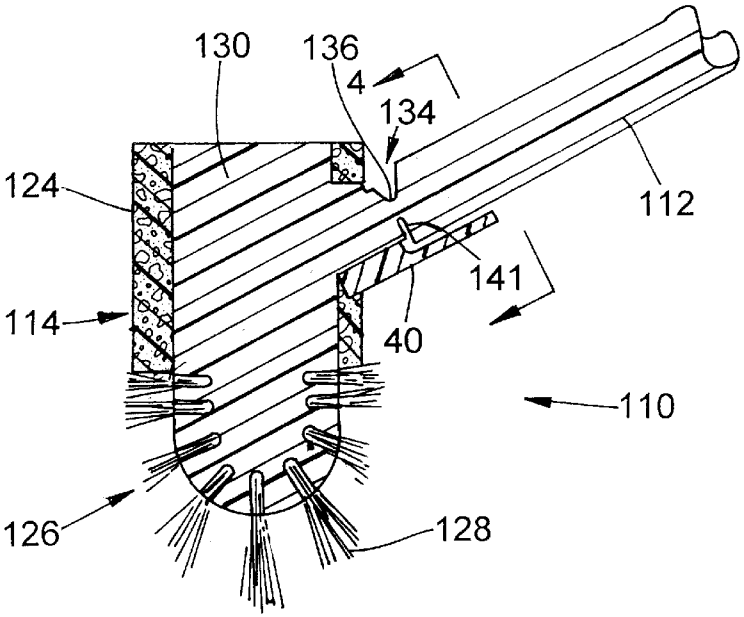
FIG. 3 is a cross-sectional view similar to FIG. 2 of a second embodiment of a toilet brush in accordance with the present invention.

Referring now to FIGS. 3 and 4, a second embodiment of a toilet brush 110 is shown. The second embodiment 110 is similar to the first embodiment and like elements have been identified with similar reference numerals having the prefix "1". For example, the handle portion 112 is the similar to the handle portion 12 of the first embodiment 10. The differences between the second embodiment of the toilet brush 110 and the first embodiment of the toilet brush 10 are described below.

As shown in FIGS. 3 and 4, the toilet brush 110 includes a handle portion 112 and a scrubbing portion 114. The main support or support block 130 for the scrubbing portion 114 is integrally formed with the handle portion 112. At least one of a scrubbing pad and a brush is connected to the support block 130 and preferably the support block 130 supports both a scrubbing pad 124 and a brush 126, as shown.

The flexible connection 134 comprises a living hinge 136 located between the support block 130 and the handle portion 112. Preferably, the living hinge 136 is configured for limited flexure in a first direction, and a greater degree of flexure in a second direction, opposite of the first direction. A deflection limiter 141 may be formed an integral part of the living hinge.

A separate deflection limiter 140 is preferably provided in order to prevent over stressing of the living hinge 136, and may be formed integrally with the support block 130 or may be provided as a separate structure which is connected to the support block 130 as shown. It will be recognized by those skilled in the art from the present disclosure that only a single deflection limiter 140, 141 need be provided with the toilet brush 110.

Preferably, the support block 130 and the handle portion 112 are molded from a polymeric material, such as polyethylene, polypropylene or any other suitable polymeric material.

It will be recognized by those in the art that the scrubbing portion 114 may be comprised entirely of bristles for a brush located in the support block 130 or may be a combination of a scrubbing pad portion 124 and bristles 128, as illustrated. Accordingly, while the scrubbing portions 14, 114 illustrated in connection with the first and second preferred embodiments include both a scrubbing pad 24 and a brush 26, the configuration of the scrubbing portion can be varied as desired within the scope of the present invention.

Figure 5:
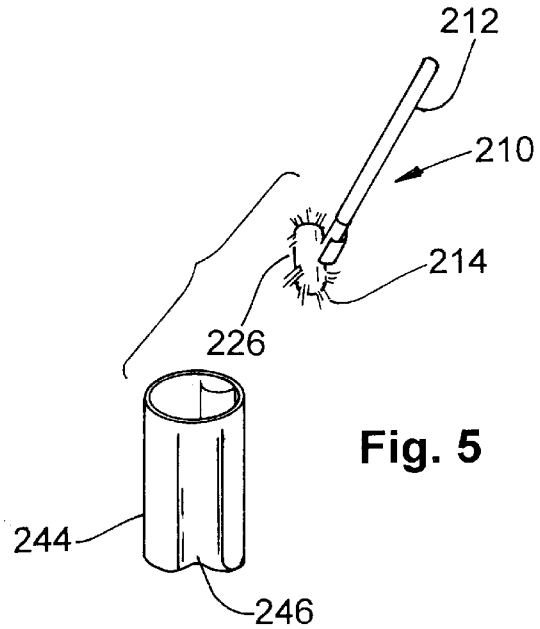
FIG. 5 is a perspective view of a third embodiment of a toilet brush in accordance with the present invention in combination with a container for receiving the scrubbing portion of the toilet brush.

Referring now to FIG. 5, a third preferred embodiment of the toilet brush 210 in accordance with a preferred embodiment of the invention is shown. The toilet brush 210 is similar to the toilet brush 110. The only difference between the toilet brush 210 in accordance with the third preferred embodiment of the present invention and the toilet brush 110 in accordance with the second preferred embodiment is that the scrubbing portion 214 consists entirely of a scrubbing brush 226.

A container 244 is provided having an open end for receiving the scrubbing portion 214 of the toilet brush 210. The container 244 preferably includes scalloped sides 246 to allow a user to more easily grasp the container 244. The container 244 can also be used in connection with the other preferred embodiments of the toilet brush 10, 110, if desired.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. A toilet brush comprising:

a handle portion;

a scrubbing portion having a first part which extends at an acute angle relative to the handle portion and a second part that extends at an obtuse angle away from the handle portion;

a flexible connection between the handle portion and the scrubbing portion; and a deflection limiter located in proximity to the flexible connection which limits deflection of the scrubbing portion only in a first direction relative to the handle portion.

2. The toilet brush of claim 1 wherein the first part of the scrubbing portion comprises a scrubbing pad located adjacent to the flexible connection, and the second part of the scrubbing portion comprises a brush extending in an opposite direction to the scrubbing pad and away from the handle portion.

3. The toilet brush of claim 1 wherein the flexible connection comprises an elastomeric material located between the handle portion and the scrubbing portion.

4. The toilet brush of claim 1 wherein the scrubbing portion includes a main support which is formed integrally with the handle portion, at least one of a scrub pad and a brush being connected to the main support, the flexible connection comprises a living hinge between the main support and the handle portion.

5. The toilet brush of claim 4 wherein the handle portion is connected to the scrubbing portion with the flexible connection being in an initial, non-deflected position, with the first part of the scrubbing portion being located at the acute angle with respect to the handle portion, the living hinge is configured for limited flexure in the first direction from the non-deflected position and a greater degree of flexure from the non-deflected position in a second direction opposite to the first direction.

6. The toilet brush of claim 1 wherein the handle portion comprises a telescoping handle.

7. A toilet brush comprising:

a handle portion;

a scrubbing portion having a main support which is formed integrally with the handle portion with a first part which extends at an acute angle relative to the handle portion and a second part that extends at an obtuse angle away from the handle portion, at least one of a scrub pad and a brush being connected to the main support;

a flexible connection comprising a living hinge integrally formed between the main support and the handle portion, the living hinge being configured for limited flexure of the handle portion from a non-deflected position relative to the scrubbing portion in a first direction, and a greater degree of flexure from a non-deflected position in a second direction opposite to the first direction.

8. The toilet brush of claim 7 further comprising a deflection limiter located in proximity to the flexible connection which limits the scrubbing portion from flexing in the first direction relative to the handle portion.

9. The toilet brush of claim 7 wherein the first part of the scrubbing portion comprises a scrubbing pad located adjacent to the flexible connection, and the second part of the scrubbing portion comprises a brush extending in an opposite direction to the scrubbing pad, away from the handle portion.

10. A combination of toilet brush and a carrying container, the toilet brush comprising:

a handle portion, a scrubbing portion having a first part which extends at an acute angle relative to the handle portion and a second part that extends at an obtuse angle away from the handle portion, and a flexible connection between the handle portion and the scrubbing portion, a deflection limiter located in proximity to the flexible connection which limits the scrubbing portion from flexing in a first direction relative to the handle portion; and a container having an open end for receiving the scrubbing portion of the toilet brush.

11. The toilet brush of claim 10 wherein the flexible connection comprises an elastomeric material located between the handle portion and the scrubbing portion.

* * * * *